United States Patent [19]

Perrine

[11] Patent Number: 4,708,339

[45] Date of Patent: Nov. 24, 1987

[54] PRE-SKI TESTING AND EXERCISING APPARATUS

[75] Inventor: James J. Perrine, Chatsworth, Calif.

[73] Assignee: Questek Corp., Chatsworth, Calif.

[21] Appl. No.: 19,749

[22] Filed: Feb. 27, 1987

Related U.S. Application Data

[63] Continuation-in-part of Ser. No. 574,724, Jan. 27, 1984, abandoned.

[51] Int. Cl.[4] ..... A63B 69/18

[52] U.S. Cl. ..... 272/97; 272/146

[58] Field of Search ..... 272/97, 70, 61, 62, 272/96, 146; 128/25 R, 25 B; 434/253

[56] References Cited

U.S. PATENT DOCUMENTS

| | | | |
|---|---|---|---|
| 2,573,808 | 11/1951 | Ravoire | 272/97 |
| 2,655,669 | 10/1953 | Schaper | 273/165 |
| 2,964,315 | 12/1960 | Dinning | 272/97 |
| 3,462,141 | 8/1969 | Robbins | 272/97 |
| 3,863,915 | 2/1975 | Pifer | 272/146 |
| 4,342,453 | 8/1982 | Wagner | 272/97 |

FOREIGN PATENT DOCUMENTS

| | | | |
|---|---|---|---|
| 609109 | 9/1948 | United Kingdom | 272/96 |

*Primary Examiner*—Richard J. Apley
*Assistant Examiner*—S. R. Crow
*Attorney, Agent, or Firm*—Keith D. Beecher

[57] ABSTRACT

Pre-ski testing and exercising apparatus comprising a pair of elongated members which may be actual or simulated skis, and which are clamped by appropriate clamping devices to a pair of rigid cross bars, each of which is supported by a pair of rocker blocks. The apparatus allows the user forceably to rock the skis, or simulated skis, forward or backwards, or from side-to-side. Also, one of the cross bars, usually the rear cross bar, may be positioned relatively higher on its rocker blocks than the forward cross bar so as to tilt the skis, or simulated skis slightly forward, even while at rest. The apparatus of the invention prevents the skis, or simulated skis, from rotating freely about their longitudinal axis, and from moving freely independently of one another. The user stands on the skis, or simulated skis, in ski boots held in bindings, and performs various exercises by attempting to rotate the skis, or simulated skis, or by rocking them forward or backwards, or from side-to-side, so as to produce various muscle actions experienced in, and necessary for common skiing maneuvers. The apparatus also enables the user to test his ski boots for proper size and adjustment.

18 Claims, 14 Drawing Figures

PRE-SKI TESTING AND EXERCISING APPARATUS

BACKGROUND OF THE INVENTION

This application is a continuation-in-part of copending application Ser. No. 574,724, filed Jan. 27, 1984, now abandoned filed in the name of the present inventor.

Over the years, many improvements have been made in skis and ski equipment. Yet, even with all the sophisticated ski boots presently available on the market, several basic practical problems remain for the average skier. These problems include, for example, at the outset, selecting the proper ski boots. Rarely do individuals get the opportunity, before purchasing to see how well the boots fit, or to see how well the boots stabilize and support their feet and ankles under actual "edging" and other weight-shifting forces which arise during skiing.

Another problem encountered by the average skier is breaking in new boots. Modern ski boots contain various types of pressure setting foam to achieve, in time, optimal support with comfort. However, until the material is worked in, through actual skiing, or simulated skiing, even small pressure areas can create considerable discomfort to the wearer, and obviate any benefits the individual might otherwise derive from the new boots.

A third problem facing the skier is that of determining the best boot buckling pattern. Modern ski boots provide multiple, adjustable buckles to permit the wearer to optimize the boot's support against the different skiing forces. Typically, individuals spend a major amount of their actual skiing time trying to find, through trial and error, the optimal setting for each buckle in order to stabilize their feet and ankles, without cutting off circulation. These settings are especially difficult to establish while the boots are still in the breaking-in-period.

Another major problem is that of pre-conditioning the feet, ankle and leg muscles which are used uniquely in skiing. Even with properly fitted ski boots, many muscles in the feet and ankles are called on to contract strongly and frequently so as to stabilize against edging and other weight-shifting forces which are encountered while skiing. When, as is typical at the start of the ski season, the particular muscles have not been used actively for several months or more, they invariably will have lost any previously developed degree of endurance. Accordingly, the muscles will begin to ache and cramp after an initial ski run or two, and directly interfere with the skier's ability to enjoy, or even to continue the skiing.

While muscle endurance can be quickly acquired through actual skiing by the younger skiers, it can take older skiers several days of skiing to redevelop their muscle endurance even to a limited degree. Therefore, most recreational skiers encounter a basic conditioning problem due to the practical limits on the duration and frequency of their yearly ski trips.

Finally, there is a problem of learning, practicing, and mastering the basic weight-shifting and balancing actions required for effective skiing. Many persons find that even the basic body motions of skiing are sufficiently unique so that they have to spend time at the beginning of each skiing season to re-learn these motions before they can regain their previous level of skiing ability. This annual re-learning factor not only delays the return of the skier to the more challenging ski runs which were mastered during the previous season, but it often serves to prevent many skiers from advancing beyond their former ability level in the time available in any particular skiing season.

Accordingly, it is an important objective of the present invention to provide a practical apparatus for securely holding and supporting skis, or simulated skis, in a normal skiing position, so as to allow the individuals to both condition and train themselves, as well as properly to select, test and break in their boots, before the actual skiing season. This is achieved by the individuals working against the inherent flex resistances presented by their boots, and/or against selected degrees of their own body weight, effectively to exert and repetitiously practice many of the basic, side-to-side edging, or front-to-back, or up and down weight-transferring and balancing actions all of which are inherent in skiing.

The invention provides a convenient and practical means for performing both preparatory tests and exercises, so that individuals may achieve better initial boot selection, boot break-in, boot adjustment proficiency, as well as more specific and effective pre-ski muscle conditioning and the reacquisition of certain basic skiing skills.

Another objective of the invention is to provide such an exercise apparatus which is capable of accepting various common sizes of skis, or simulated skis; which can be quickly set up or dismantled; and which, when dismantled, can be conveniently packaged and hand carried.

Another objective of the invention is to provide such apparatus which is inexpensive to produce, and which can be sold at a relatively low price.

BRIEF DESCRIPTION OF THE DRAWINGS

FIG. 1 being a view from one side and above the assembly, and FIG. 2 being a view from in front of and above the assembly;

DETAILED DESCRIPTION OF THE ILLUSTRATED EMBODIMENTS

Figure 2:
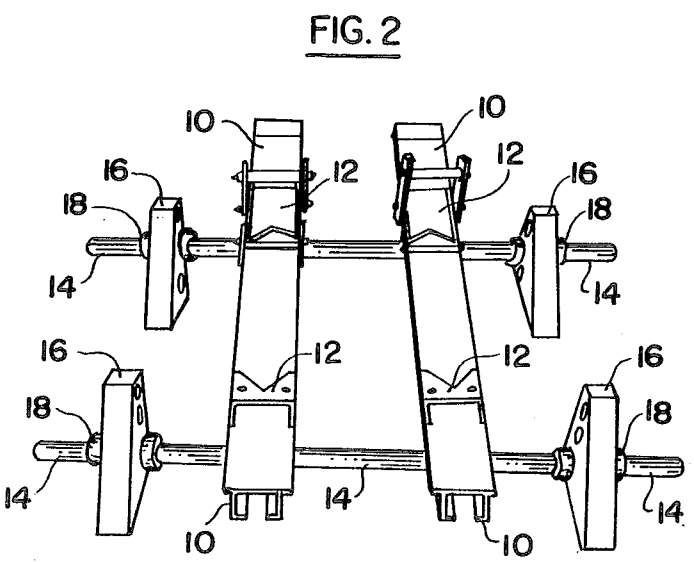
FIGS. 1 and 2 are perspective representations of a pair of simulated skis mounted on supporting rocker blocks in accordance with one embodiment of the invention.
Figure 1:
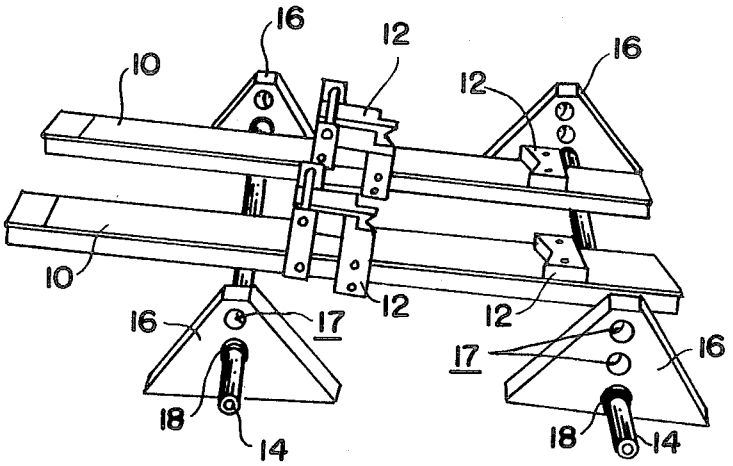

As shown in FIGS. 1 and 2, two simulated skis 10 are clamped in spaced and parallel relationship to two transverse bars or tubular members 14. The simulated skis may take the form of elongated aluminum channels of the illustrated configuration. The bars 14 respectively extend across the simulated skis 10 just in front of and just behind the bindings which are designated 12.

Each of the bars 14 is supported on first and second triangular-shaped rocker blocks 16 respectively positioned near its ends. Each bar may be supported by rocker blocks 16 at a selected height above the supporting surface, by inserting it in one of a number of holes 17 in each rocker block 16. In the illustration of FIGS. 1 and 2, for example, the rear bar 14 is supported in the central holes in its rocker blocks, and the forward bar is supported in lower holes, so that the simulated skis 10 are tilted slightly in the forward direction. The bars 14 are held in the corresponding rocker blocks 16 by appropriate sleeves, such as sleeves 18.

Figure 3:
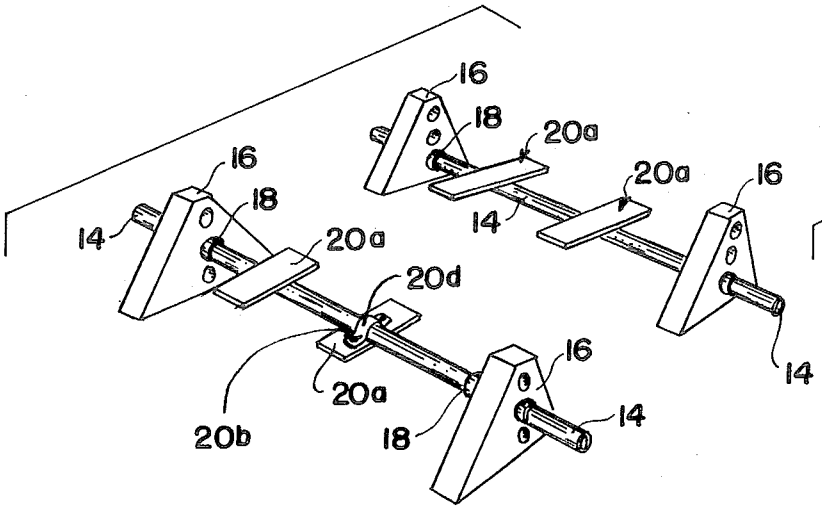
FIG. 3 is a perspective representation of one embodiment of the invention constructed to support a pair of simulated skis.

The simulated skis 10 of FIGS. 1 and 2 are held on bars 14 by clamping plates 20*a* shown in FIG. 3. Each clamping plate 20*a* is adapted to be received under the corresponding simulated ski, and a U-shaped adjustable clamp 20*d* is provided for attaching the plate 20*a* to the corresponding bar 14. As shown in FIG. 3, a total of four clamping plates 20*a* are used to attach the simulated skis 10 to the two transverse bars 14. One of the clamping plates 20*a* is shown inverted in FIG. 3 to reveal clamp 20*d*. The clamp is attached to plate 20*a* by two screws, one of the screws being provided with a wing nut 20*b* which is manually turned to tighten the plate 20*a* down on the flange of the simulated ski 10, and to tighten the flange against bar 14.

Figure 4:
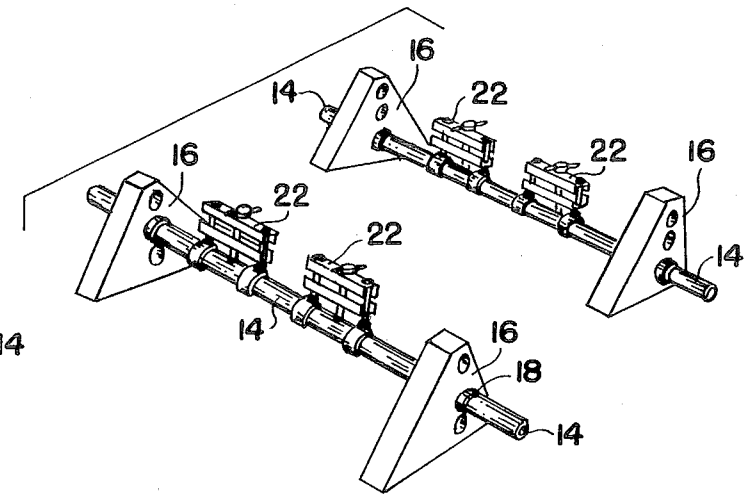
FIG. 4 is a perspective representation of a second embodiment of the invention constructed to support a pair of either simulated or actual skis.
Figure 5:
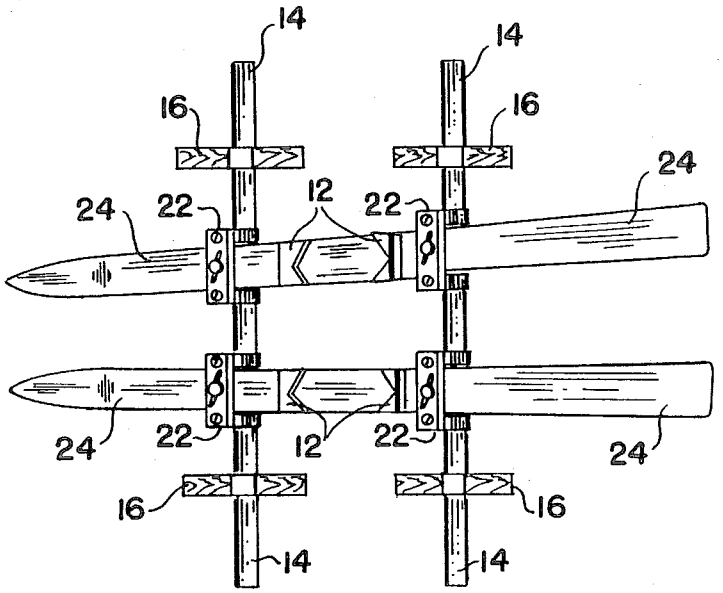
FIG. 5 shows a pair of actual skis supported in the apparatus of the invention of the type shown in FIG. 4.

A different type of clamping assembly is shown in FIG. 4 which is designated 22. This latter clamping assembly may be used to clamp either actual skis, or the simulated skis of FIGS. 1 and 2 to the transverse bars 12. FIG. 5 shows a pair of actual skis 24 attached to the apparatus of FIG. 4 by means of the clamping assemblies 22.

The ski exercising apparatus shown in FIGS. 1–5 essentially prevents the skis, or simulated skis, from rotating about their longitudinal axes, or from moving freely independently of one another, in either a vertical or horizontal plane, while, at the same time, permitting users to stand on the skis, or simulated skis, with their ski boots secured to bindings, and with their weight shifted slightly forward onto the balls of their feet, similar to the prevailing conditions for downhill skiing. Then, by working variously against the flex resistance of the boots, and/or against their own body weight, the users can simulate various skiing actions, and can experience corresponding and representative skiing forces upon their feet, ankles and legs.

The various maneuvers that can be carried out by the users include, for example, (1) forceably to angulate their feet and legs, and to shift their body weight from side-to-side, as in edging, against the corresponding side-flex resistance of their boots. As a test, this action reveals any free play that might be present in this plane in the boots. As an exercise, this action works the many lateral stabilizing muscles in the feet, ankles and legs. (2) To rock forward and backward against the corresponding flex resistance of the boots, as well as the individual's partial body weight, to test for any free boot/ankle movement permitted by the boots in this plane, and/or to exercise the various anterior and posterior flexor muscles of the feet, ankles and legs. (3) Alternately to lift one leg and then the other against the resistance created by the individual's partial body weight, transmitted through the non-lifted leg to the clamping/supporting devices, so as to exercise the leg-lifting muscles in the legs, pelvis and trunk.

Figure 6:
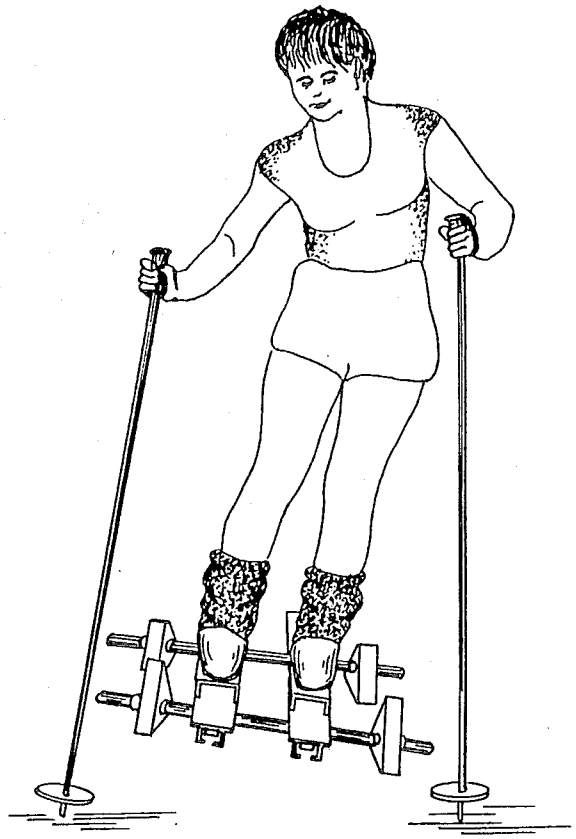
FIG. 6 is an illustration of a user using the apparatus of the invention (with simulated skis) specifically to perform a side balance/lift exercise.

For example, as shown in FIG. 6, a user may perform a one-side weight balance and opposite-side lift action, similar to skiing through bumps. For this exercise, the cross bars of the clamping devices rock and pivot around the attached rocker blocks. This exercise strongly works leg lifting and trunk side flexion muscles, with the degree of resistance encountered being determined by the distance the rocker blocks are spaced from the bindings of the skis, or simulated skis.

Figure 7:
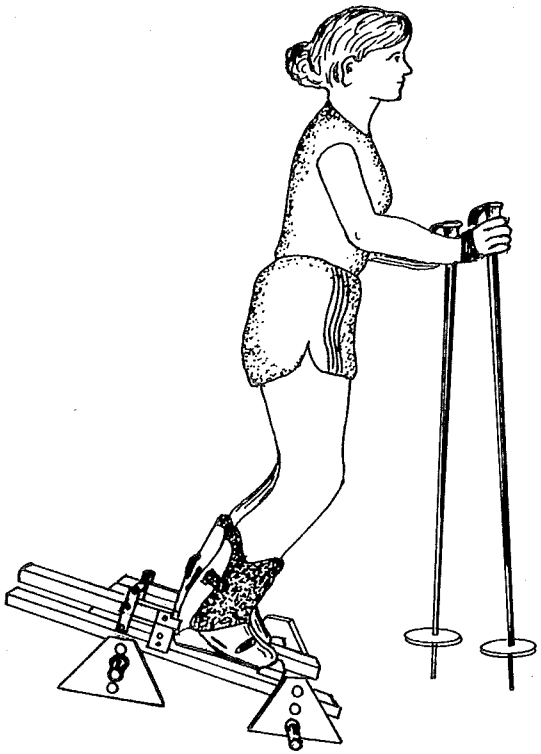
FIG. 7 is an illustration of a user using the apparatus to perform a forward lean exercise.

As shown in FIG. 7, the subject may perform a forward lean exercise, thereby strongly contracting plantar flexion muscles of the ankles, plus corresponding stabilizing muscles in the feet. For this exercise the rear clamping device and corresponding rocker blocks are pulled off the ground, with the degree of resistance encountered being determined by the forward flex resistance of the ski boots and the distance the front cross bar is positioned in front of the ski boots. In like manner, the resistance encountered while performing a backward rocking-front lifting exercise may also be varied. It should be noted that the position of the cross bars is readily adjustable, by loosening the clamping devices of FIGS. 3 or 4, and sliding the assemblies shown in FIGS. 3 or 4 either forwardly or rearwardly with respect to the supported skis, or simulated skis, and by then tightening the clamping assemblies.

Figure 8:
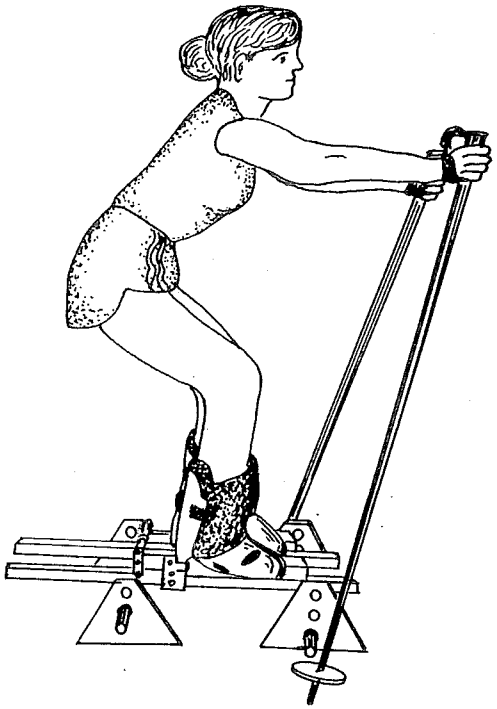
FIG. 8 is an illustration of a person using the apparatus to perform a quad-dip exercise.

In FIG. 8 the subject is shown performing a quad-dip exercise, with the arms fully forward as in a race start position. This exercise works the quadriceps (knee extensor) muscles in substantially the same way as in skiing.

A number of other exercises may also be performed by the apparatus of the invention, as will become readily apparent to anyone having basic skiing experience, using the apparatus. Accordingly, while the foregoing examples are illustrative of some of the basic types of skiing tests and/or exercises which may be performed by use of the apparatus of the invention, many other tests and/or exercise movement-variations may be readily performed, to exercise different muscle groups in different ways, and to allow individuals to select pre-ski tests and exercises so as to suit their own particular needs and objectives.

Figure 14:
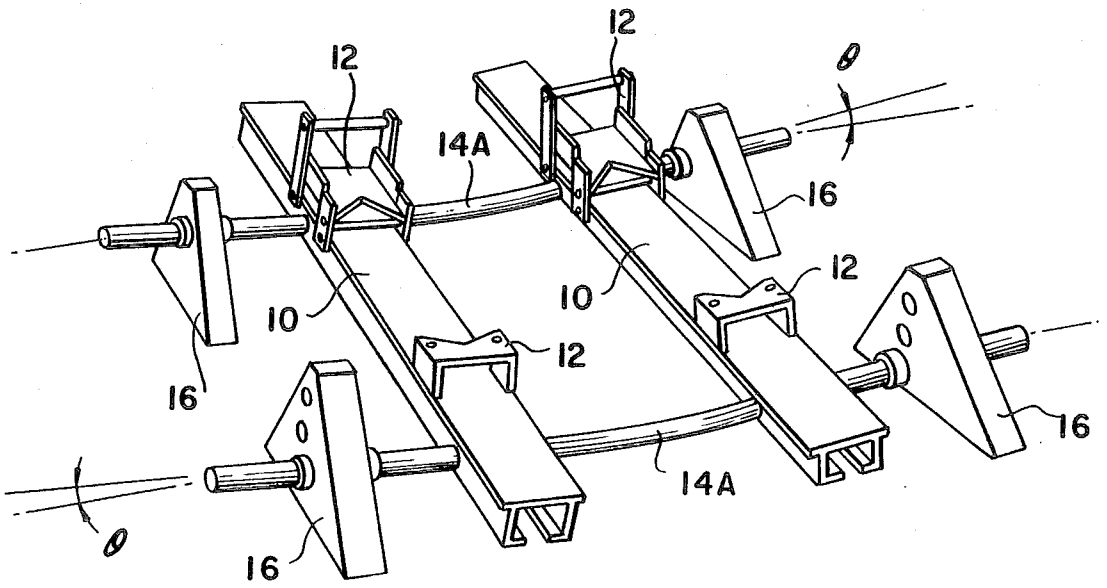
FIG. 14 is a perspective representation of yet another embodiment of the invention.

The embodiment shown in FIG. 14 is similar to the embodiment of FIGS. 1 and 2, except that the cross bars 14 are curved, as shown, and are designated 14A in the latter embodiment. The curved cross bars 14A place the simulated skis on a realistic "inside edge". The inclination is of the order of 3°–5°, depending on the spacing between the simulated skis. Not only is this inclination of the simulated skis advantageous in itself, but it enables the user to space the simulated skis 10 further apart than in the previous embodiment, and to use the assembly with a wider, more stable stance.

This inclination of the simulated skis, with a wider stance and matching inward inclinations of the boots to orient each foot bed perpendicular to the longitudinal axis of the legs, permits the weight bearing forces through the foot, ankle and knee joints to be favorably aligned. Comfort at the knees may be noticeably improved when the embodiment of FIG. 14 is used, particularly for individuals subject to knee discomfort from small foot/leg misalignments during strenuous knee flexion-extension activities or exercises.

With the simulated skis 10 spaced a natural 8–10 inches apart, and on both a 5° inside edge angle, and a 5° forward slope angle, the latter being achieved by placing the rear cross bar one hole higher in the rear rocker blocks 16 than the front cross bar, causes the basic exercise orientation to feel even more like a typical Alpine skiing orientation. The fact that both simulated skis are simultaneously on an inside edge inclination during the exercises does not adversely affect this sensation. Significantly, in the specific edging exercise, where angled weight bearing/edging forces are applied to one leg and foot at a time, the lines of force and pressure distributions become virtually identical to that developed on an outside-downhill leg and foot during turns on the actual ski slope.

Moreover, with the wider spacing between the simulated skis which is rendered possible by the embodiment of FIG. 14, the hip angulation and body angulation of the user can be increased to a realistic degree during the basic mode exercise. In the side-to-side leg/pelvis flexion exercise, the range of motion can be increased considerably, and the knee and hip flexors, pelvis stabilizers, and abdominal obliques are all given a very thorough workout. In the full body flexion-extension exercise, the wider, more stable stance facilitates a more dynamic exercise action, and functional weighting/unweighting practice. The other exercise described above similarly benefit from the wider stance and favorable joint alignments made possible by the embodiment of FIG. 14.

Figure 9:
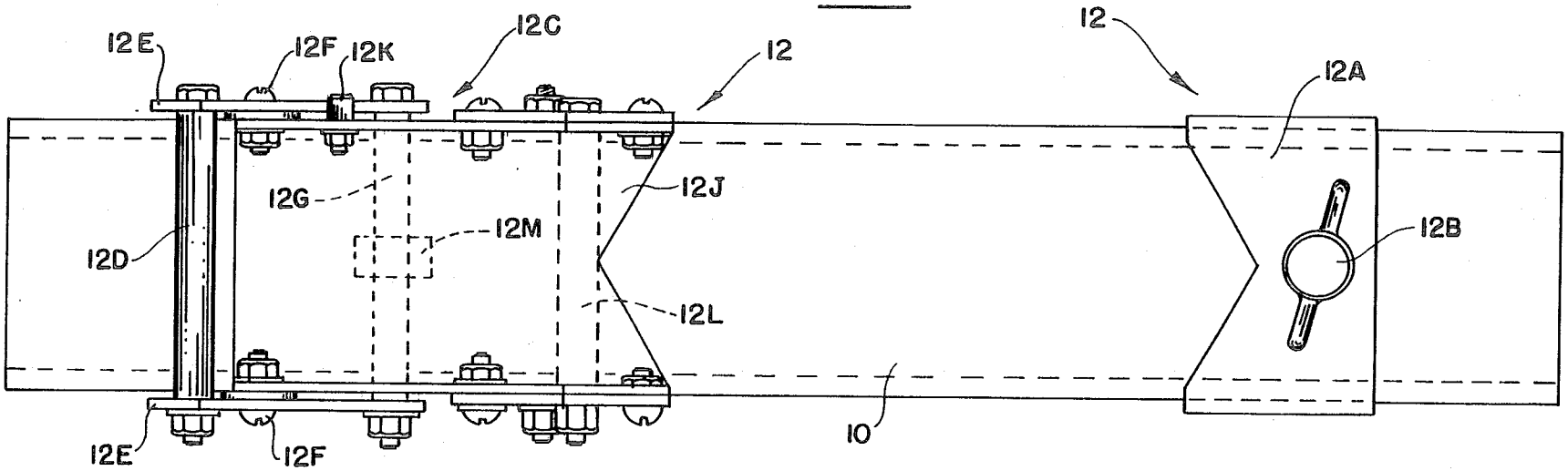
FIGS. 9–13 are various views of bindings mounted on each of the simulated skis to support the boots of the user.
Figure 10:
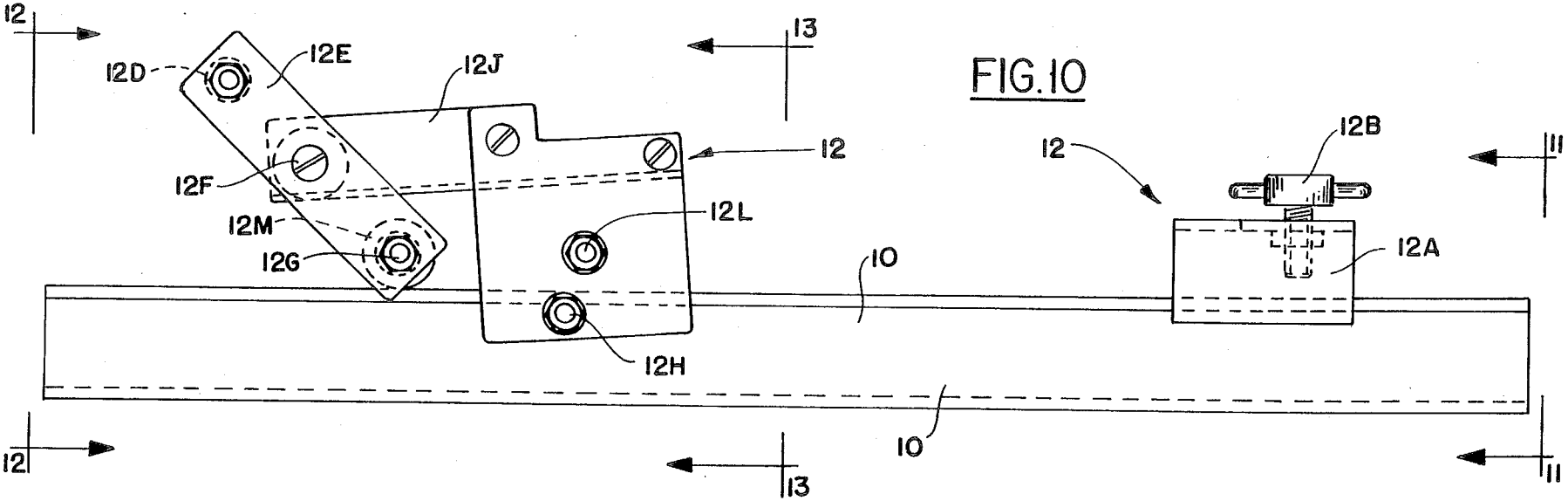
Figure 12:
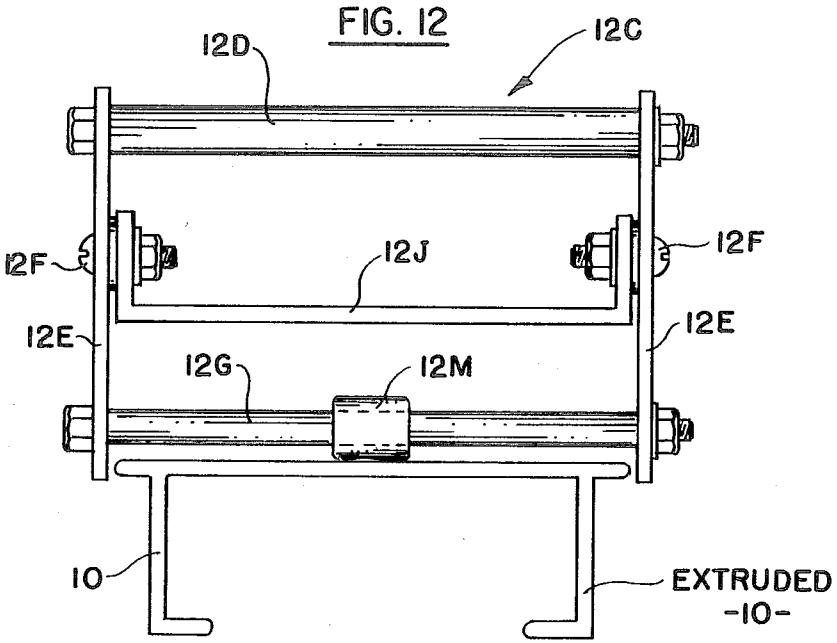
Figure 11:
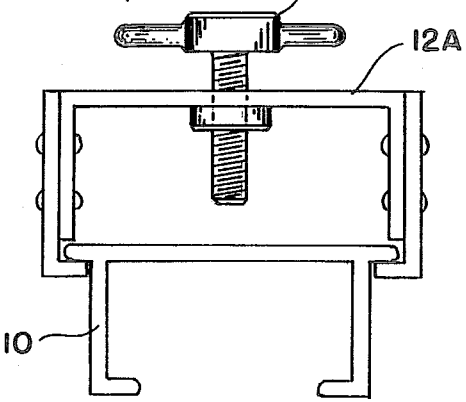
Figure 13:
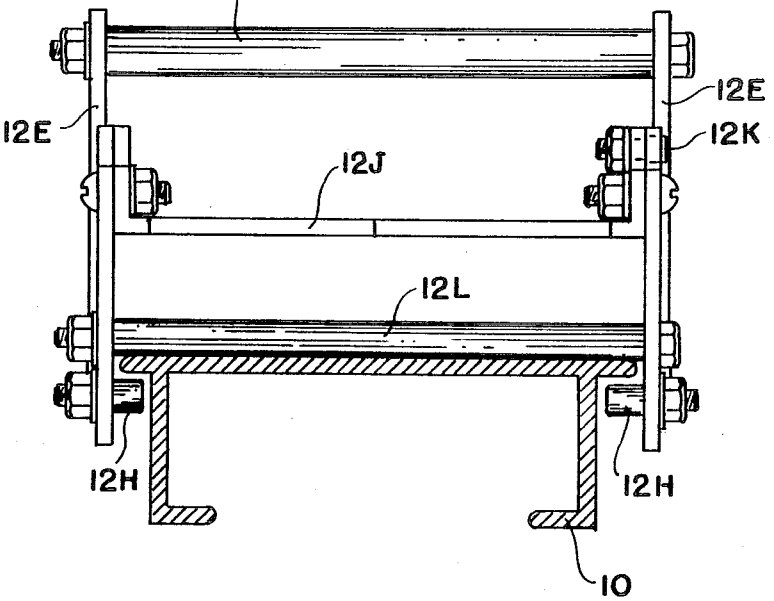

The bindings 12 used in conjunction with the simulated skis 10 of FIGS. 1, 2, 6–8 are shown in greater detail in FIGS. 9–13. FIG. 9 is a top view of one of the bindings mounted on one of the simulated skis 10, FIG. 10 is a side view, and FIGS. 11–13 are end and sectional views taken along the lines 11—11, 12—12, and 13—13 of FIG. 10.

As shown in FIGS. 9, 10 and 11, the binding 12 includes a forward bracket 12A which is intended to receive the toe of the ski boot. Bracket 12A may be moved back and forth along simulated ski 10, and may be clamped at any selected position on the ski by tightening a set screw 12B against the top of the simulated ski, as shown in FIG. 11. The binding 12 also includes a rear bracket 12C for supporting the heel of the ski boot. Bracket 12C may likewise be moved back and forth along the simulated ski 10 when in its released position.

The usual procedure is to locate the bracket 12A at a desired position on the simulated ski, and clamp that bracket in place. Then, the toe of the ski boot is brought adjacent to the rear end of the bracket 12A to protrude under the rear end. The rear bracket 12C is then moved along the ski until it contacts the heel of the ski boot, at which time a lever bar 12D is pulled upwardly to turn a pair of levers 12E about pins 12F, so as to bring a cross bar 12G down against the upper surface of the simulated ski 10 with levers 12E in an upright position. A resilient bushing 12M is provided on bar 12G which engages the top of the simulated ski 10 when the rear bracket 12C is in its clamping position.

For that position of the lever arms, the forward edge of a bracket 12J is brought down over the upper edge of the heel of the ski boot with a pair of pins 12H being held firmly against the rim of the simulated ski 10, as shown in FIG. 3. This enables that the bracket 12J to be firmly clamped down against the edge of the heel of the ski boot, holding the ski boot firmly in place. When levers 12D are in their upright clamping position, one of the levers 12D engages a limit stop 12K.

The rear bracket 16 may be released merely by pulling back bar 12D, to turn the lever arms 12E in a counterclockwise direction in FIG. 10, which releases the bracket. A further bar 12L is provided which extends across the top of the simulated ski 10, and which holds the bracket in position when it is in its released condition, to enable the bracket easily to be moved back and forth along the ski 10.

While the foregoing binding structures enable the exercise device to be used by a person wearing ski boots, it is obvious that other binding means can be substituted to enable the device to be used by a person wearing street shoes, or athletic shoes, etc.

It will be appreciated that while particular embodiments of the invention have been shown and described, modifications may be made, and it is intended in the following claims to cover all modifications which come within the true spirit and scope of the invention.

I claim:

1. An apparatus for pre-ski testing and exercising by a person wearing ski boots, and comprising: first means for fixing said ski boots in a spaced, parallel and inwardly inclined relationship to one another, such that they cannot be moved freely independently of one another in either a vertical or horizontal plane; and second means defining axial fulcrums displaced outward a fixed distance from the center of weight of the body of the person on both sides of the body and in front and behind the body for allowing the person to forcibly lift the front or rear or either side of said first means against the body weight of the person, and rock said first means from side-to-side about said fulcrums, and rock said first means forward and backwards about said fulcrums.

2. The apparatus defined in claim 1, in which said first means comprises a pair of elongated members in the form of simulated skis; and which includes bindings for the ski boots mounted on each of said elongated members.

3. The apparatus defined in claim 2, in which said first means further includes holding means for holding the elongated members in a spaced, parallel, and inwardly inclined position.

4. The apparatus defined in claim 3, in which said holding means includes at least one rigid member extending tranversely across said elongated members, and means for securing said elongated members to said rigid member.

5. The apparatus defined in claim 4, in which said rigid member holds said elongated members in adjustable spaced apart positions.

6. The apparatus defined in claim 4, in which said rigid member comprises a bar, and which includes clamping means for attaching said elongated members to said bar, with the elongated members being rockable with the bar about the longitudinal axis of the bar and with the elongated members being adjustable along the length of the bar.

7. An apparatus for pre-ski testing and exercising by a person wearing ski boots, and comprising: first means for fixing said ski boots in a spaced and parallel relationship to one another, such that they cannot be moved freely independently of one another in either a vertical or horizontal plane; and second means for allowing the person to forcibly rock said first means from side-to-side, and rock said first means forwards and backwards, and to lift said first means up and down against the corresponding flex resistances of the boots and against the body weight of the person, said first means comprising a pair of elongated members, and further comprising holding means for holding the elongated members in a spaced and essentially parallel position, said holding means including at least one bar extending transversely across said elongated members, clamping means for attaching said elongated members to said bar, with the elongated members being rockable with the bar about the longitudinal axis of the bar and with the elongated members being adjustable along the length of the bar, bindings for the ski boots mounted on each of the elongated members, in which each of the elongated members comprises a simulated ski having a channel-shaped cross-section, and in which each of said clamping means includes a plate extending into a corresponding one of the channel-shaped simulated skis, and a U-shaped clamp extending around the bar, and adjustable to clamp the plate and corresponding simulated ski to the bar.

8. The apparatus defined in claim 6, in which the clamping means each comprises a member positioned to extend transversely across the top of a corresponding one of said elongated members, and adjustable means for clamping the corresponding one of the elongated members to the bar.

9. The apparatus defined in claim 1, in which said second means comprises at least one rocker block for supporting said first means.

10. An apparatus for pre-ski testing and exercising by a person wearing ski boots, and comprising: first means for fixing said ski boots in spaced and parallel relationship to one another, such that they cannot be moved freely independently of one another in either a vertical or horizontal plane; and second means for allowing the person to forcibly rock said first means from side-to-side, and rock said first means forwards and backwards, and to lift said first means up and down against the corresponding flex resistances of the boots and against the body weight of the person, in which said first means comprises a pair of elongated members in the form of skis or simulated skis; and which includes bindings for the ski boots mounted on each of said elongated members, and in which said first means further includes holding means for holding the elongated members in a spaced and essentially parallel position, in which said holding means comprises a first bar extending transversely across the elongated members adjacent the forward end of the binding on each of said elongated members, and a second bar extending transversely across the elongated members adjacent to the rear end of the binding on each of said elongated members, and clamping means mounted on each of said bars for attaching each of said elongated members to said bars with the elongated members being rotatable about the axis of rotation of both said bars.

11. The apparatus defined in claim 10. in which said second means includes a pair of rocker blocks for each of said bars, each of said rocker blocks having apertures therein for receiving the respective end portions of the corresponding one of said bars to support each of said bars a predetermined distance above a supporting surface.

12. The apparatus defined in claim 11, in which each of said rocker blocks has a plurality of holes therein for supporting each of said bars at selected heights above the supporting surface.

13. The apparatus defined in claim 4, in which said rigid member has a curved configuration effectively to incline each of said elongated members toward the respective inner edges thereof.

14. The apparatus defined in claim 13, in which the inclination of each of said elongated members is of the order of 5°.

15. The apparatus defined in claim 7, in which each said bars has a curved configuration for inclining each of said elongated members toward the inner edge thereof.

16. The apparatus defined in claim 15, in which the inclination of each of said elongated members is of the order of 5°.

17. The apparatus defined in claim 10, in which said rigid member has a curved configuration effectively to incline each of said elongated members toward the respective inner edges thereof.

18. The apparatus defined in claim 10, in which the inclination of each of said elongated members is of the order of 5°.

* * * * *